United States Patent [19]

Ulmer et al.

[11] Patent Number: 4,993,869

[45] Date of Patent: Feb. 19, 1991

[54] CONCRETE FINISHING MACHINE WITH VIBRATING FINISHING ROLLERS

[75] Inventors: Ewald R. Ulmer; Murray A. Rowe, both of Canton, S. Dak.

[73] Assignee: CMI Corporation, Oklahoma City, Okla.

[21] Appl. No.: 334,923

[22] Filed: Apr. 7, 1989

[51] Int. Cl.[5] ..... E01C 19/38

[52] U.S. Cl. ..... 404/117

[58] Field of Search ..... 404/103, 117, 128; 74/87

[56] References Cited

U.S. PATENT DOCUMENTS

| | | | |
|---|---|---|---|
| 1,550,027 | 8/1925 | Hug . | |
| 2,728,277 | 12/1955 | McRae . | |
| 2,745,326 | 5/1956 | Green . | |
| 3,176,597 | 4/1965 | Seaman . | |
| 3,415,174 | 12/1968 | Kaltenegger . | |
| 3,703,128 | 11/1972 | Fransson . | |
| 3,722,380 | 3/1973 | Kaltenegger | 404/117 |
| 3,737,244 | 6/1973 | Wilson | 404/117 |
| 3,850,541 | 11/1974 | Baillet et al. | 404/114 |
| 4,068,970 | 1/1978 | Rowe | 404/120 |
| 4,256,415 | 3/1981 | Rowe et al. | 404/116 |
| 4,320,987 | 3/1982 | Rowe et al. | 404/115 |
| 4,466,757 | 8/1984 | Allen | 404/114 |
| 4,619,552 | 10/1986 | Sadahiro | 404/117 |
| 4,717,282 | 1/1988 | Anderson | 404/122 |
| 4,749,305 | 6/1988 | Brown et al. | 404/117 |
| 4,775,262 | 10/1988 | Guntharp et al. | 404/103 |
| 4,830,534 | 5/1989 | Schmelzer et al. | 404/117 |

FOREIGN PATENT DOCUMENTS

| | | | |
|---|---|---|---|
| 354052 | 8/1974 | U.S.S.R. | 404/117 |

*Primary Examiner*—William P. Neuder
*Attorney, Agent, or Firm*—Emrich & Dithmar

[57] ABSTRACT

A concrete finishing machine includes a surfacing unit having one or more finishing rollers supported on the surfacing unit carriage by a finishing roller vibrating assembly which includes a frame supporting the finishing rollers at one end and on which is mounted a pair of vibrator units producing vibrational forces which are applied to the finishing rollers through the frame, the vibrator units being mounted on a common beam and spaced apart laterally of one another whereby horizontal forces are cancelled and only vertical amplitude vibrational forces are applied to the finishing rollers.

20 Claims, 7 Drawing Sheets

CONCRETE FINISHING MACHINE WITH VIBRATING FINISHING ROLLERS

BACKGROUND OF THE INVENTION

This invention relates to concrete finishing machines for use in finishing concrete surfaces of roadways and the like, and more particularly to a concrete finishing machine having a vibrating finishing roller assembly.

Concrete finishing machines used in finishing concrete surfaces of roadways and the like, employ apparatus for vibrating the concrete to condition the surface of the concrete being finished for enhancing and improving the finished surface. One known type of concrete finishing machine includes vibrator apparatus in the form of a pan which is dragged along the surface of the concrete being finished ahead of the finishing rollers. The pan is vibrated as it is dragged forwardly along the roadway, or the like. Another concrete finishing machine, disclosed in the U.S. Pat. No. 4,320,987 of Murray A. Rowe, et al, includes a vibrating apparatus which is movable back and forth transversely over the roadway being surfaced, with the vibrating apparatus extending into the concrete being finished to condition concrete ahead of the finishing rollers. The vibrator apparatus includes generally L-shaped rod members suspended on a support frame and actuated as by an hydraulic motor to be raised and lowered relative to the roadway being finished.

In another arrangement disclosed in U.S. Pat. No. 4,068,970 to Murray A. Rowe, a concrete finishing machine includes a screen mechanism for striking-off and smoothing spread concrete. The screen mechanism is vibrated to vibrate the concrete to the proper density and best quality finish during finishing.

Although finishing processes using these known concrete vibrator apparatus improve the quality of the concrete surface finish, the extent to which these finishing processes can provide the finish desired for the concrete being worked id dependent upon the water/cement ratio. In some applications, the specifications for the concrete mix require drier concrete, and the water/cement ratio is reduced. This increases the strength of the cured concrete, but renders the concrete less workable and increasingly more difficult to finish. To finish drier specification concrete, it is desirable to additionally work the surface in a manner that moves the rock-aggregate below the surface and increases the workable fines to the surface.

SUMMARY OF THE INVENTION

It is an object of the present invention to provide an improved concrete finishing machine.

Another object of the present invention is to provide a concrete finishing machine which is particularly suitable for use in finishing concrete having a reduced water to cement ratio.

Yet another object of the invention is to provide a concrete finishing machine having finishing roller means which is vibrated in sue for providing optimum density of the concrete surface being finished.

Another object of the invention is to provide a concrete vibrator apparatus which is adapted for mounting to an existing concrete finishing machine for vibrating finishing roller means thereof.

These and other objects are achieved by the present invention which has provided a concrete finishing machine of the type embodying an elongated main frame adapted for movement longitudinally along a roadway or the like being surfaced, and a surfacing unit for finishing a concrete surface, the surfacing unit including a carriage supported by the main frame and adapted for movement back and forth along the main frame laterally of the roadway and including finishing roller means having first and second ends and suspension means for rotatably mounting said finishing roller to the carriage with the finishing roller being located above the surface of the concrete being finished in engaging relationship therewith. A drive means is supported on the carriage and coupled to the finishing roller at the first end thereof for rotating the finishing roller as the carriage is moved along the main frame. A vibrating means is supported by the suspension means near the second end of the finishing roller. The vibrating means is coupled to the finishing roller means at the second end for vibrating the finishing roller. The vibrating means includes first and second vibrator units constructed and arranged for producing vibrational forces having components which add in a vertical plane and components which cancel in a horizontal plane. The suspension means includes isolating means interposed between the vibrating means and the carriage for preventing the transmission to the carriage of vibrational forces produced by the vibrating means.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF A PREFERRED EMBODIMENTS

Figure 1:
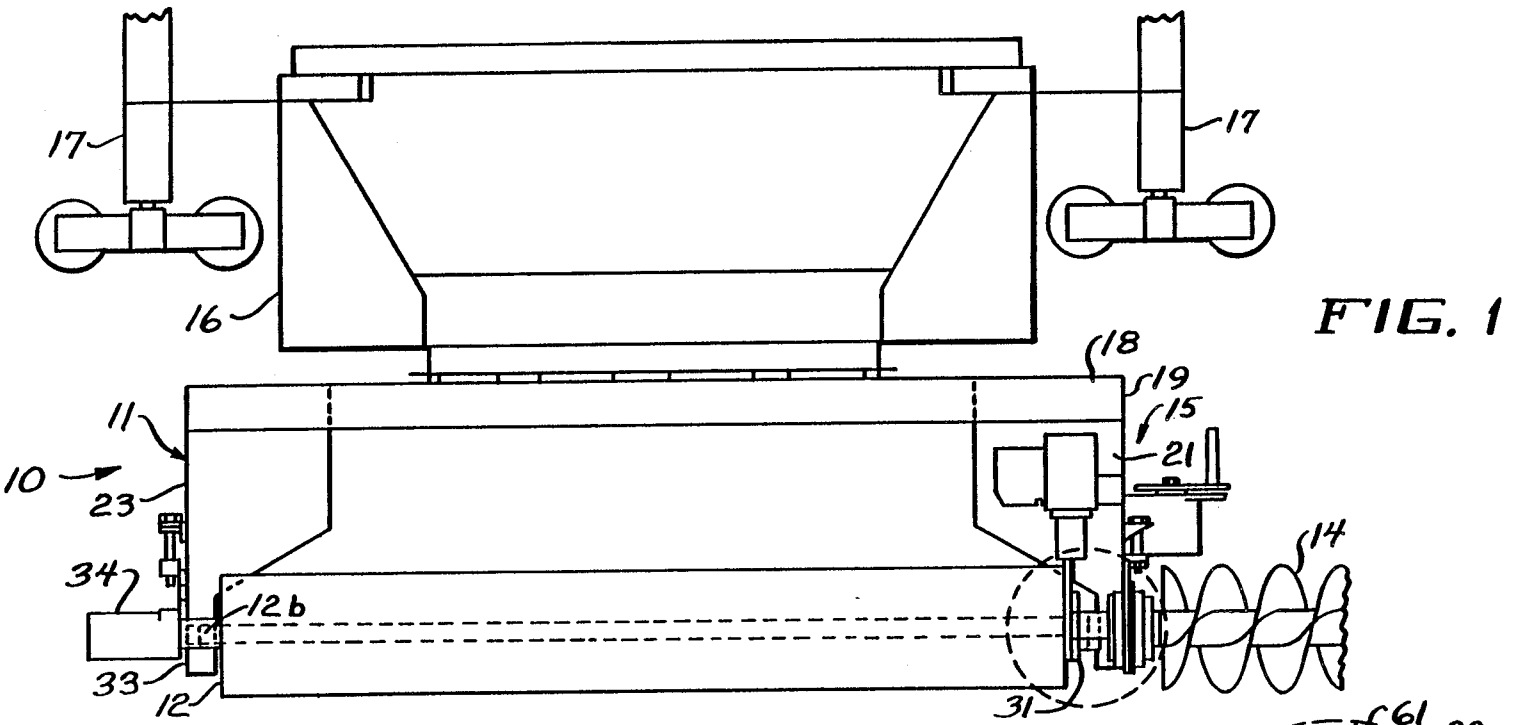
FIG. 1 is a side elevational view of a concrete finishing machine including a surfacing unit having a pair of finishing rollers supported at their front ends by a roller vibrating assembly provided by the present invention.
Figure 2:
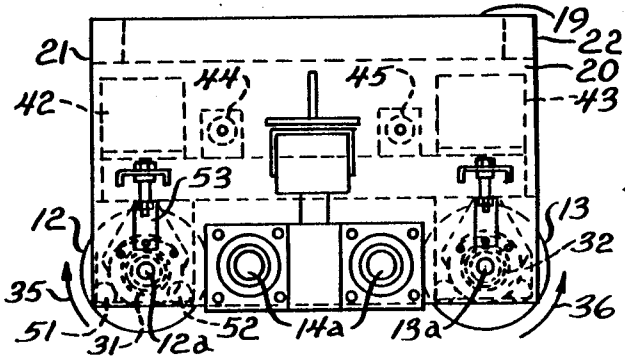
FIG. 2 is an end elevational view of the surfacing unit of the concrete finishing machine shown in FIG. 1; p

Referring to FIGS. 1 and 2, there is shown a concrete finishing machine 10 including a surfacing unit 11 having a pair of finishing rollers 12 and 13, a pair of augers 14 and a finishing roller vibrating assembly indicated generally by reference numeral 15 provided by the present invention. The concrete finishing machine 10 may be of the type embodying a main frame 16, only a portion of which is shown, adapted for movement on rollers 17 longitudinally along a roadway being surfaced, carrying with it the surfacing unit 11. The surfacing unit 11 includes a carriage 18 which is adapted for movement back and forth along the main frame transversely of the roadway as is known in the art.

The carriage 18 of the surfacing unit 11 includes a support frame 19 which supports the finishing rollers 12 and 13 and the augers 14 over the concrete surface being finished. The frame 19 has a front panel 20, side panels 21 and 22 and a rear panel 23. The finishing rollers are supported over the surface being finished to set the grade for the concrete surface, the finishing rollers being rolled across the surface being finished. The augers 14 are carried on shafts **14*a* and are disposed between the finishing rollers 12 and 13 and extend forwardly of the finishing rollers 12 and 13** in a substantially horizontal, uniplanar spaced relation to draw concrete toward the space between the augers as well as longitudinally outwardly along the augers, away from the finishing cylinders, as is known in the art, to turn the concrete to grade prior to finishing by the finishing rollers. Examples of such concrete finishing machine are disclosed in the U.S. Pat. No. 3,528,348, to Rowe et al, entitled CONCRETE FINISHING MACHINES, and in the U.S. Pat. No. 4,708,520, to Murray A. Rowe, entitled CONCRETE FINISHING MACHINE WITH ADJUSTABLE AUGER UNIT, both of which are assigned to the assignee of the present application.

The manner in which the concrete finishing machine 10 moves along the roadway as well as the manner in which the surfacing unit 11 moves laterally relative to the main frame 16 during finishing operation is known in the art and will not be described in detail.

The finishing rollers 12 and 13 have their forward shaft portions **12*a* and 13*a* received in respective bearing units 31 and 32 which are supported by the roller vibrating assembly 15 as will be described. Each of the finishing rollers 12 and 13 has its rearward shaft portion, such as shaft portion 12*b* for roller 12, supported by the drive motor shaft via drive coupling 33 which is mounted in the rear panel 23. Each of the finishing rollers 12 and 13, is driven by a motor, such as motor 34 for finishing roller 12, the two finishing rollers 12 and 13 being rotated in either same or opposite directions about their shafts. By way of example, when roller 12 is rotated clockwise as represented by arrow 35 in FIG. 2, roller 13 is rotated counterclockwise, as indicated by arrow 36**.

Figure 3:
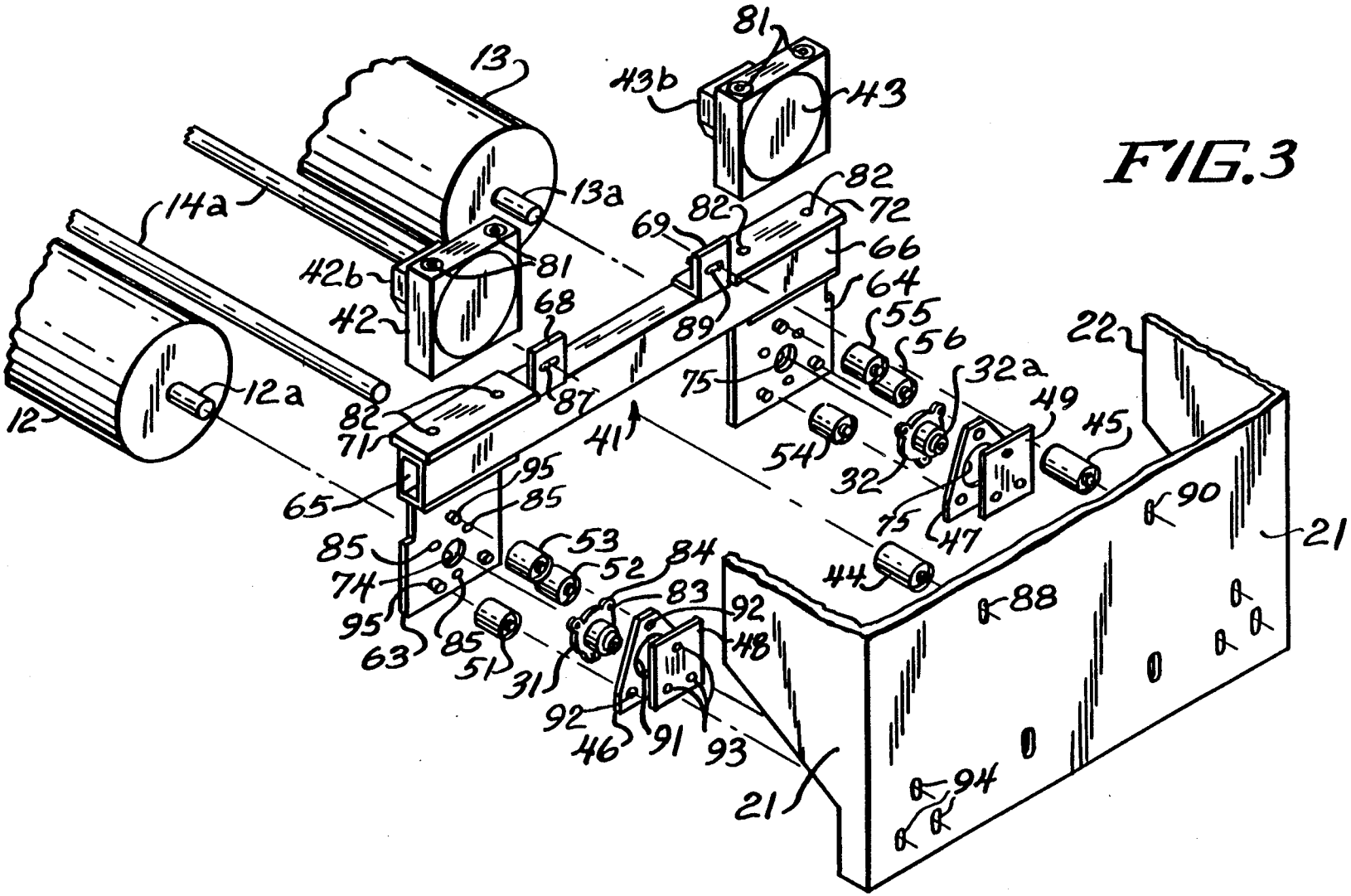
FIG. 3 is an exploded perspective view of the forward end of the surfacing unit illustrating the roller vibrating assembly provided in accordance with the present invention for the concrete finishing machine shown in FIG. 1.

Referring now to FIGS. 2 and 3, the roller vibrating assembly 15 includes a frame 41, a pair of vibrator units 42 and 43, vibration isolating members 44 and 45, mounting adaptor plates 46 and 47, and isolating members 51–56. The frame 41 includes a box beam 61 which is oriented transversely of the surfacing unit 11. The beam 61 has a pair of depending plate members 63 and 64 located at opposite ends 65 and 66 of the beam 61 which support the bearing units 31 and 32 for the finishing rollers. Beam 61 has a pair of upwardly extending ears 68 and 69 which are spaced inwardly from the ends 65 and 66 of the beam 61, respectively, which facilitate mounting of the beam 61 to the finishing carriage. The beam 61 also has a pair of mounting plates 71 and 72 which facilitate mounting of respective vibrator units 42 and 43 to the beam 61 at opposite ends thereof. Beam 61, plates 46–49 and plate members 61–64 are made of a rigid metal.

The vibrator units 42 and 43 are supported on mounting plates 71 and 72 respectively at opposite ends 65 and 66 of the beam 61 and secured thereto by bolts (not shown) which thread apertures 81 in the vibrator unit 43, and tapped apertures 82 in the mounting plates 71, 72.

Bearing unit 31 is secured to plate member 63 by bolts (not shown) which thread apertures 83 through mounting lugs 84, spaced equidistant about the periphery of the bearing unit 31, and apertures 85 in the plate member 63 and are secured thereto by nuts (not shown). Plate member 63 has an aperture 74 which is aligned with the axial opening **31*a* of the bearing unit 31 and through which extends the forward shaft portion 12*a* of the finishing roller 12. The bearing unit 32 which supports the forward end of finishing roller 13 is secured to plate member 64 in a similar manner with the forward shaft portion 13*a* of finishing roller 13 extending through aperture 75 in plate member 64 and through axial opening 32*a* of the bearing unit 32**.

The subassembly including beam 61, vibrator units 42 and 43 and bearing units 31 and 32 is attached to the finishing carriage by isolating members 51–56, each of which comprises a generally cylindrical center portion, fabricated of rubber or other resilient material to isolate vibrations produced by the vibrator units 42 and 43 from the carriage. Isolating member 44 is secured to frame 41 by bolt not shown) which passes through an aperture 87 in ear 68 and is secured by a nut (not shown), embedded in member 44. The member 44 is secured to front panel 20 by a bolt (not shown) which extends through an aperture 88 in the front panel 20 of the carriage 18 and is secured by a nut (not shown), embedded in the member 44. Similarly, isolating member 45 is attached to the frame 41 by a bolt (not shown)

which extends through an aperture 89 in ear 69 and is secured by a nut (not shown) embedded in the member 45. Member 45 is attached to the front panel 20 by a bolt (not shown) which passes through aperture 90 and is secured by a nut (not shown) embedded in the member 45.

Figure 1A:
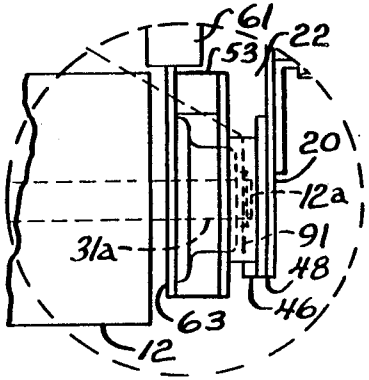
FIG. 1A is an enlarged fragmentary view of the portion of the concrete finishing machine contained within the circle in FIG. 1.

Referring to FIGS. 1A and 3, the mounting adaptor plate 46 has a central aperture 91 which receives the forward end of the bearing unit 31. The spacer plate 48 is interposed between the forward surface of mounting adaptor plate 46 and the inner surface of the front panel 20. Mounting adaptor plate 46 is generally triangular in shape and has apertures 92 adjacent each apex and which are aligned with corresponding apertures 93 in the spacer plate 48 and apertures 94 in the front panel 20. The isolator members 51–53 are secured to front panel 20 bolts (not shown) which extend through the aligned apertures 92–94 and are secured by nuts (not shown) embedded in the members 51–53. Apertures 94 in the front panel 20 are elongated to permit vertical height adjustment of the forward end of the finishing roller 12. The other ends of the isolator members 51–53 are secured to frame 61 by bolts (not shown) which extend through apertures 95 in plate member 63 and are secured thereto by nuts (not shown) embedded in the members 51–53. The mounting adaptor plate 47, spacer plate 49 and isolating members 54–56 similarly secure the bearing unit 32, which supports the forward end of finishing roller 13, to the carriage 18.

As shown best in FIG 1A, the spacer plates, such as spacer plate 48, locate the end of the finishing roller spaced inwardly from the inner surface of the front panel 20, and enclose the forward surface of the mounting adaptor plate 46. Thus, the spacer plate encloses within aperture 91 of mounting adaptor plate 46 the forward shaft portion **12*a* of the finishing roller 12 and the forward portion of the bearing unit 31 which is received in aperture 91 in the mounting adapter plate 46**.

Referring to FIGS. 1 and 2, the two vibrator units 42 and 43 are mounted forward and above the finishing rollers 12 and 13. Vibrational forces are transmitted from the vibrator units 42 and 43 to the finishing rollers 12 and 13 through the bearing units 31 and 32 which support the forward shaft portions **12*a* and 13*a* of the finishing rollers. The forward shaft portions 12*a* and 13*a* of the finishing rollers 12 and 13 are held in position by the vibrating roller frame 41 which is coupled to the carriage, through the rubber vibration isolating members 44, 45 and 51–56** as has been described. The vibration isolators serve to positively position the finishing rollers without constraining the vibration amplitude of the rollers.

Figure 4:
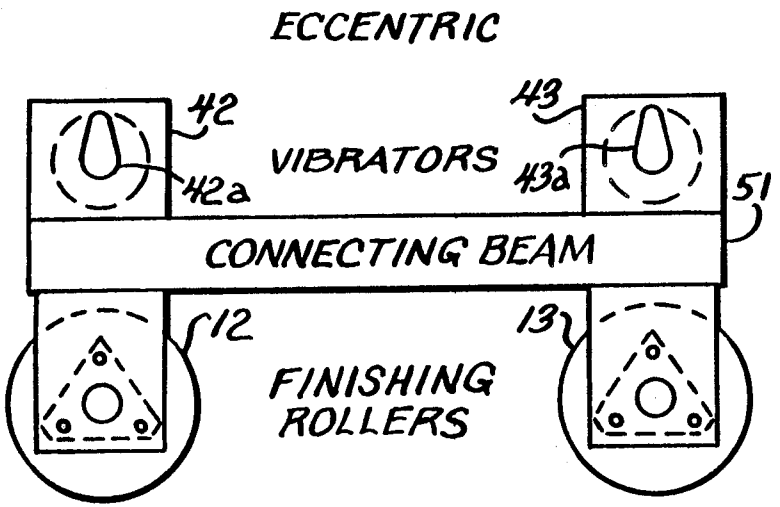
FIG. 4 is a simplified representation of the roller vibrating assembly of the concrete finishing machine.

Referring to FIG. 4, the vibrator units 42 and 43 are of the type known in the art and each includes an eccentric movable member **42*a*, 43*a*, the two vibrator units 42 and 43 are synchronized and driven in opposite directions by associated drive motors 42*b* and 43*b* (FIG. 3). Because the two vibrator units 42 and 43 are mounted on a common beam 61 and spaced apart laterally of one another, horizontal vibration forces are cancelled, and the vibrator units 42 and 43 apply only a vertical vibration amplitude to the finishing rollers 12 and 13**.

Figure 5:
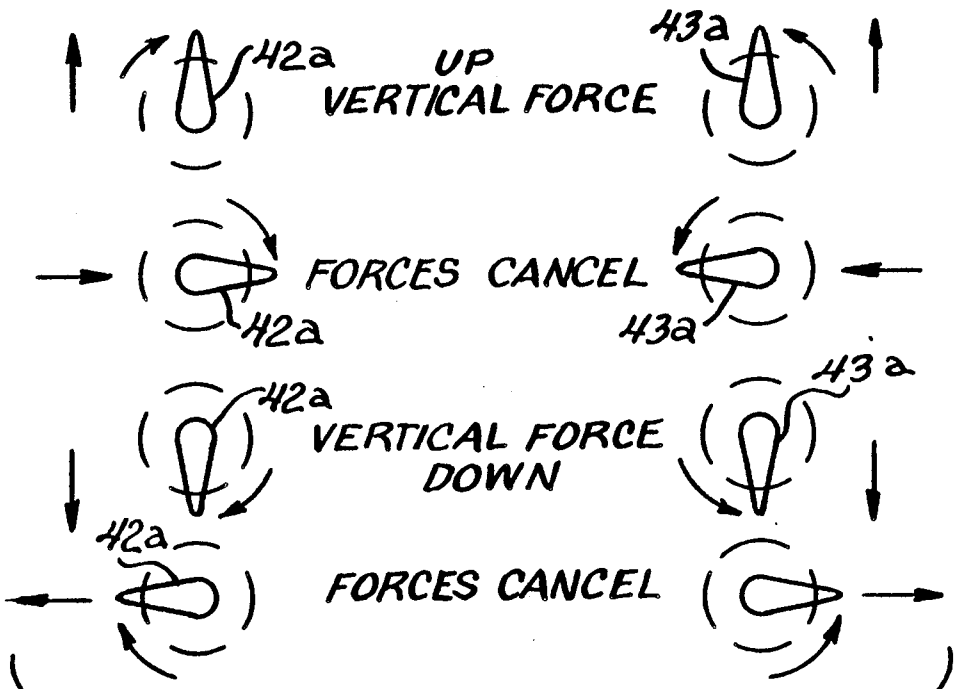
FIG. 5 is a simplified representation of a force diagram for the vibrating assembly illustrating cancellation of horizontal forces produced thereby.
Figure 6:
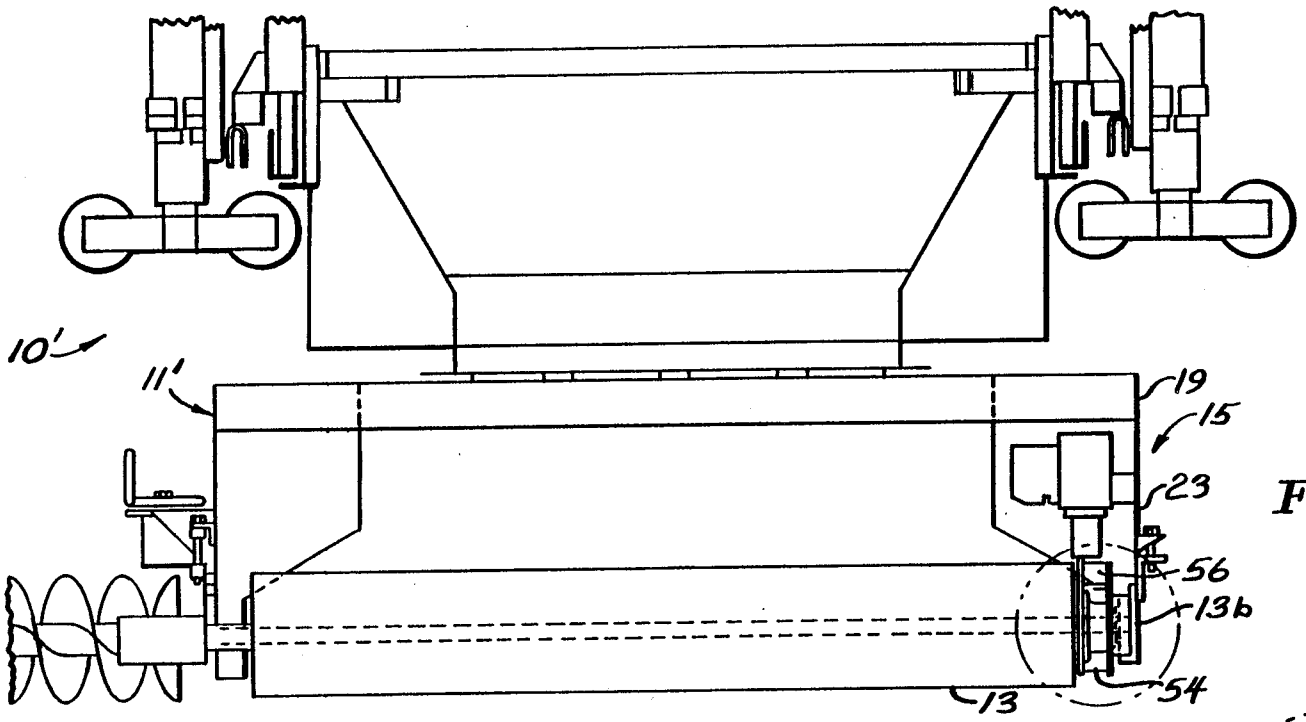
FIG. 6 is a fragmentary view similar to FIG. 1 of a further embodiment of a concrete finishing machine having vibrating finishing rollers wherein the roller vibrating assembly is located at rearward ends of the finishing rollers.
Figure 6A:
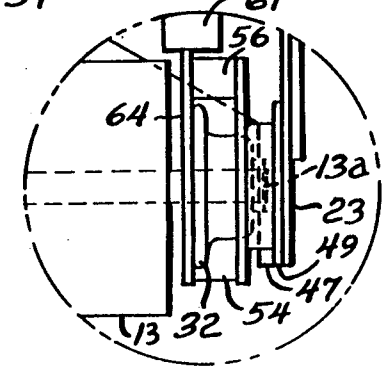
FIG. 6A is an enlarged fragmentary view of the portion of the concrete finishing machine contained within the circle in FIG. 6.

As shown in FIG. 5, which is a simplified representation of a force diagram for the vibrator units 42 and 43, when the eccentric members **42*a*, 43*a*, of both units are at their upper most position, there is a net vertical force upwardly. After 90° of rotation of the members 42*a*, 43*a* of the two vibrator units, the forces of both units are directed toward the center of the beam 61 with the result that the horizontal forces cancel. With an additional 90° of rotation of the members 42*a*, 43*a* of the two mechanisms, a downward force will be directed at each end of the beam 61, producing a vertical force down for the vibrating units. With a further 90° of rotation of members 42*a*, 43*a* of the members, both vibrating units will direct a force outwardly of the beam 61 or away from the center of the beam 61, resulting in cancellation of horizontal components of the vibrational forces applied to the forward ends of the finishing rollers. Referring to FIGs. 6 and 6A, there is illustrated a further embodiment for a surfacing unit 11' for a concrete finishing machine 10' similar to that just described, but wherein the finishing roller vibrating assembly 15 is located at the rearward ends of the finishing cylinders, such as at end 13*b* for finishing roller 13. Also, the finishing rollers, such as finishing roller 13, are driven at their forward ends. The manner in which the finishing roller vibrating assembly 15 is mounted to the carriage 19 and supports the finishing rollers 12 and 13 by their bearing units 31 and 32 is substantially the same as that just described. For example, as shown in FIG. 6, the finishing roller vibrating assembly 15 is secured to the rear panel 23 and the finishing roller 13 is supported at its rearward end 13*b* by the bearing unit 32 which in turn is supported by the adaptor mounting plate 47 and spacer plate 49. The isolating members, such as isolating members 54 and 56 illustrated in FIG. 6, isolate vibrational forces from the carriage 11' in the manner described for the forward end mounting arrangement. The manner in which finishing roller 12 is supported at its rearward end by the finishing roller vibrating assembly 15 is apparent from the foregoing description for mounting the finishing roller 12** at its forward end.

Figure 7:
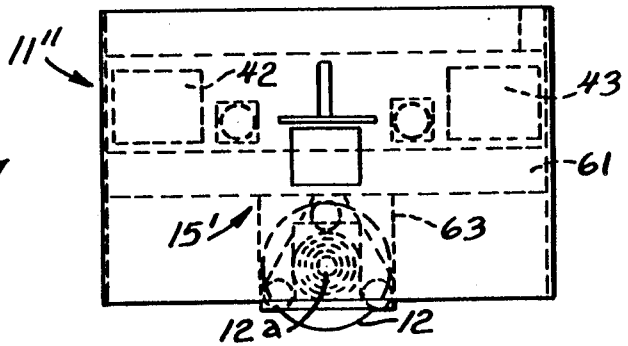
FIG. 7 is an end elevational view of a finishing carriage for a concrete finishing machine in which the finishing carriage has a single finishing roller supported by the roller vibrating assembly of the present invention.

The principle of using dual beam mounted vibrator units to provide a net vertical vibrational force can be applied to a surfacing unit employing a single finishing roller. Referring to FIG. 7, there is illustrated a further embodiment for a surfacing unit 11'' which employs a single finishing roller 12 one end of which is vibrated by the finishing roller vibrating assembly 15' which includes dual vibrator units 42 and 43 mounted on a beam assembly including a beam 61. In this embodiment, only one mounting adaptor plate 63 is provided to support the forward end of the finishing roller 12. Other details of the mounting are the same as those described above with reference to FIGS. 1–5. It is apparent that such single roller can be vibrated at its forward end or at is rearward end, with the finishing roller being driven respectively at its rearward end or forward end.

Figure 8:
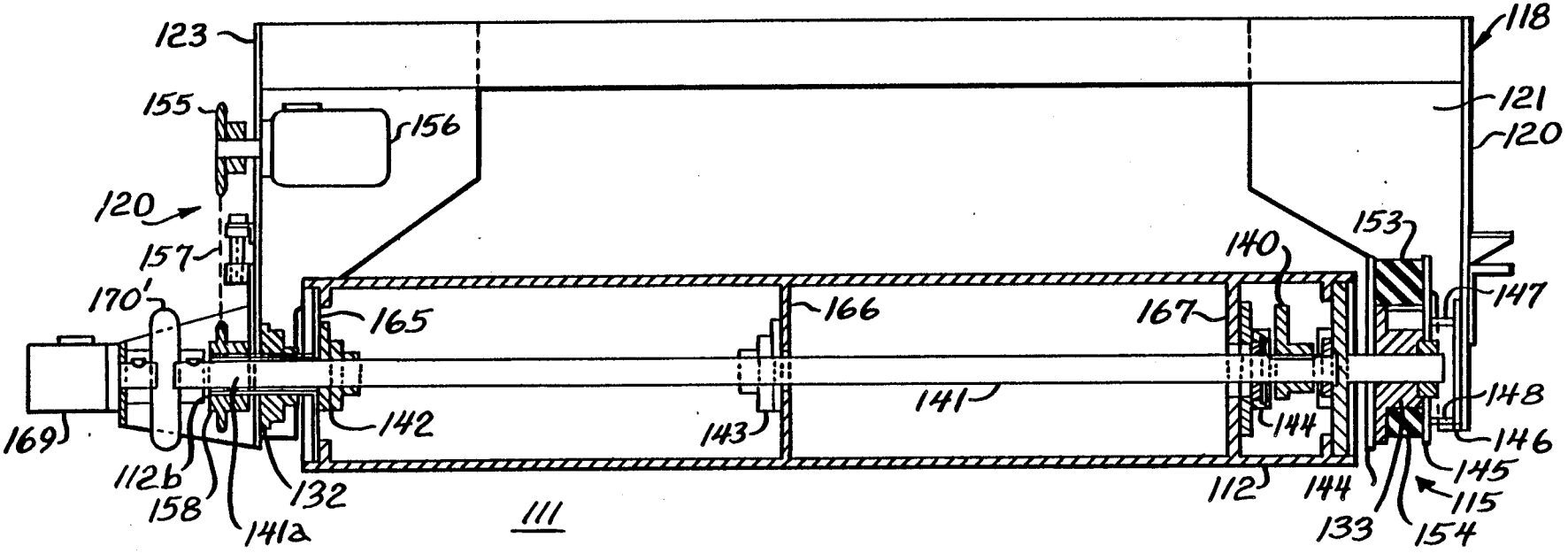
FIG. 8 is a side sectional view of a surfacing unit having two finishing rollers, each including a single, internal eccentric member for producing vibration of the finishing rollers.
Figure 9:
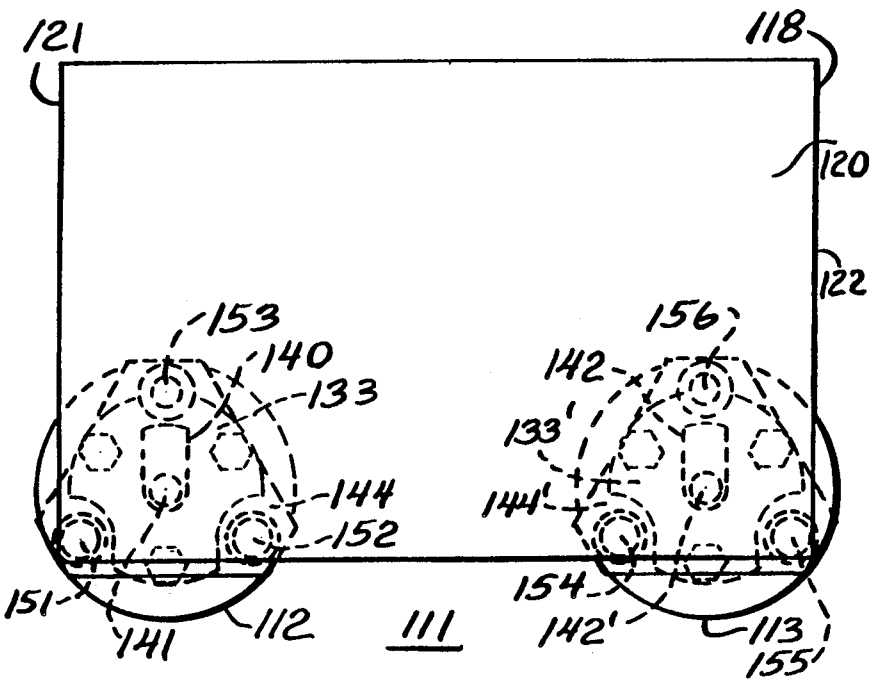
FIG. 9 is an end view of the surfacing unit of FIG. 8.

Referring to FIGS. 8 and 9, there is illustrated a further embodiment for a surfacing unit 111 provided by the present invention. The surfacing unit 111 includes a carriage 118 having two finishing rollers 112 and 113 which are supported by a finishing roller mounting assembly 115 near their forward ends and which are driven by a driver assembly 120 at their rearward ends. The finishing rollers 112 and 113 are vibrated at their forward ends. In this embodiment, vibrational forces are applied to the forward end of the finishing roller 112 by a single internal eccentric member 140 which is located near the forward end of the finishing roller 112. The eccentric member 140 is carried on a shaft 141 extending through the finishing cylinder 112 and rotates with the shaft. Similarly, the forward end of finishing roller 113 is vibrated internal eccentric member 142 carried by shaft 142'.

The carriage 118 includes a front panel 120, side panels 121 and 122 and a rear panel 123. Bearings 132 and 133 support the rearward end **112*b* and forward end 112*a*, respectively of the finishing roller 112. Bearing 132 is secured to the inner surface of the rearward panel 123. The bearing 133 is supported by a roller mounting assembly 115. Mounting assembly 115 includes two mounting plates 144 and 145, spacer plate 146 having leg portions 147 and 148 and vibration isolating members 151–153. The spacer plate 146 is secured to the inner surface of the forward panel 120 with leg portions 147 and 148 extending rearwardly and permanently attached to mounting plate 145 which define a box-like configuration to provide rigidity. The mounting plate 144 has the bearing unit 133 thereto secured. Isolating members 151–153, in turn, secure mounting plate 144 to the mounting plate 145. Each of the isolating members 151–153 includes a resilient or rubber like center member and suitable fastening means such as threaded nuts (not shown) embedded therein to receive mounting bolts (not shown) for securing mounting plate 144 to the mounting plate 145. Finishing roller 113 is rotatably mounted to the carriage 118 in a similar manner and vibrated by eccentric member 142. The forward end of finishing roller 113 is supported by a mounting assembly including vibration isolates 154–156 (FIG. 9) similar to the mounting assembly for finishing roller 112. The isolating members 151–156 function in the manner of isolating members 51–56 to prevent the vibrations applied to the finishing rollers 112** from being transmitted to the carriage.

The finishing cylinders 112 and 113 are driven by a drive assembly 120 including sprocket member 155 which is driven by a motor 156, chain 157 and sprocket wheel 158 which is attached to the rearward end **112*b* of roller 112, a similar sprocket member being attached to the rearward end of roller 113, for driving the finishing rollers 112 and 113** in the same or opposite directions.

The shaft 141 which carries the eccentric member 140 is supported by baring units 142, 143 and 144 which are mounted on respective inner walls 165, 166, and 167, respectively, of the roller 112. The eccentric member 140 is secured to the shaft 141 for rotation therewith at a location near the forward end to the roller 113. The rearward end **141*a* of the shaft 141 extends through the end 112*b* of the finishing roller 112 and is coupled to a drive motor 169 by a suitable coupling means 170' to allow the shaft 141 to be rotated within the cylinder 112. As shaft 141 is rotated, vibrational forces are applied through bearing units 143 and 144 to the forward end of the finishing roller 112. A similar arrangement is provided for the shaft and eccentric member 142 mounted on finishing roller 113**.

Figure 10:
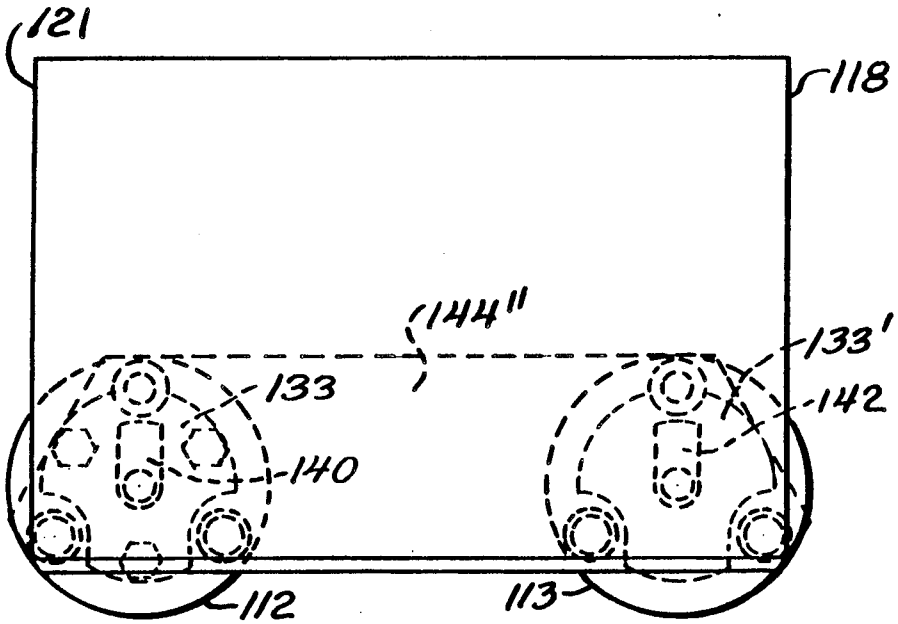
FIG. 10 is an end view of a surfacing unit having two finishing rollers with internal eccentric vibration producing members mechanically tied together to cancel horizontal vibrational forces.

Referring to FIGS. 9 and 10, the two mounting plates 144 and 144' which carry the forward end bearing units 133 and 133' for the two cylinders 112 and 113, respectively, may be mechanically connected together or may comprise a single plate 144'' as illustrated in FIG. 10. In this way, the two finishing rollers 112 and 113, with respective internal eccentric members 140 and 142 which produce the vibration in the two rollers, are structurally tied together to cancel horizontal vibrational forces in a manner similar to that described above with reference to the embodiment shown in FIGS. 1–5, for example, where the vibrating units 42 and 43 are carried on a common beam 61. It is apparent that the finishing rollers can be driven at their forward ends and vibrated at their rearward ends by reversing the mounting arrangements and relocating the eccentric members and the drive systems.

Figure 11:
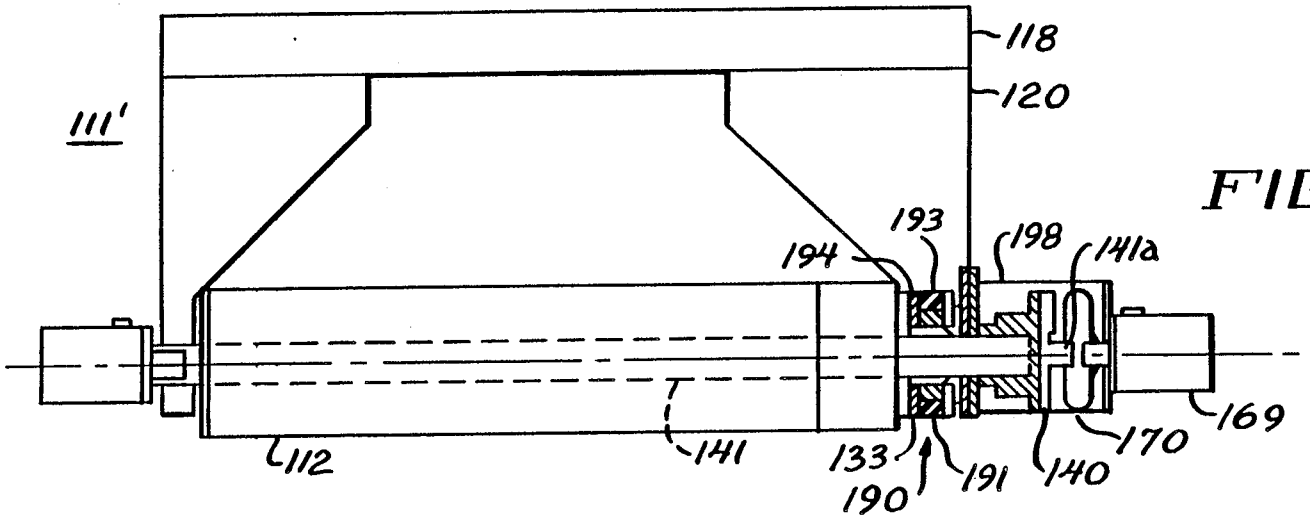
FIG. 11 is a side elevational view of a further embodiment of a surfacing unit having a pair of finishing rollers each having a single, external eccentric member for producing vibration of the finishing rollers.
Figure 12:
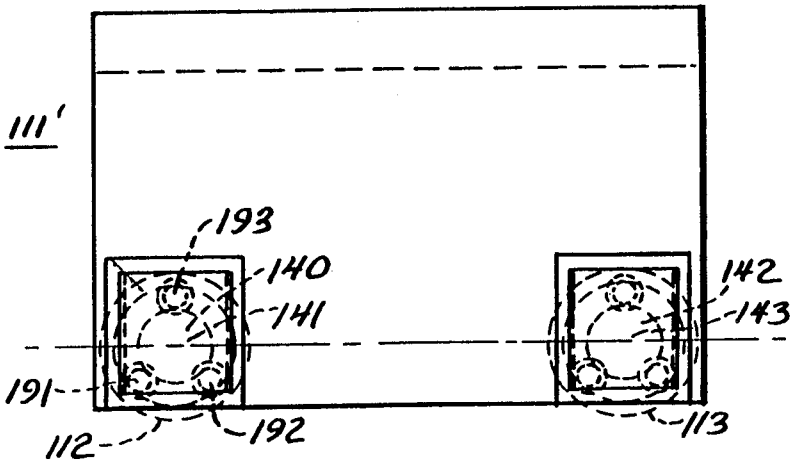
FIG. 12 is an end view of the surfacing unit illustrated in FIG. 11.

Referring to FIGS. 11 and 12, there is illustrated a further embodiment for a surfacing unit 111' which is similar to that illustrated in FIGS. 8–9, but wherein the eccentric members, such as member 140 for roller 112, which vibrate the two finishing rollers 112 and 113 are located externally of the two finishing rollers 112 and 113 at their forward ends. In this embodiment, the forward end of the finishing roller 112 is supported by a mounting adapter assembly 190 with isolating members 191–193 interposed between the plate 94 which mounts the bearing for the finishing roller and the plate 195 which is attached to the front panel 120 of the carriage 118. In this embodiment, the shaft 141 which carries the eccentric member 140 extends through the bearing 133 to the front end of the finishing roller whereat the eccentric member 140 is attached to the shaft. The shaft is driven by a motor 169 at the forward end which is coupled through a coupling 170 to the forward end **141*a* of the shaft 141. The eccentric member 140 and the coupling 170 are enclosed within a housing 198 which is secured to the front panel 120. The drive coupling further isolates the eccentric drive member from the housing to prevent vibrations produced thereby from being coupled to motor 169 and the carriage of the surfacing unit 111'**.

The finishing roller 113 is rotatably mounted to the carriage in a manner similar to that described above for finishing roller 112. A single, external eccentric member 142 carried on and rotated by shaft 143 produces vibrational forces for cylinder 113. The two finishing rollers 112 and 113 may be tied together by mechanically interconnected their bearing unit mounts, as described above, such that horizontal vibrational forces produced by the two eccentric members are cancelled.

We claim:

1. In a concrete finishing machine including a main frame adapted for movement along a roadway or the like being surfaced, a finishing unit for finishing a concrete surface of the roadway, comprising:

a carriage supported by the main frame and adapted for movement back and forth along the main frame laterally of the roadway;

finishing roller means including at least one elongated finishing roller having first and second ends;

suspension means for rotatably mounting said finishing roller to said carriage with said finishing roller being located above the surface of the concrete being finished in engaging relationship therewith;

drive means supported on said carriage and coupled to said at least one elongated finishing roller at said first end thereof for rotating said at least one elongated finishing roller as said carriage is moved along said main frame;

vibrating means supported by said suspension means near said second end of said at least one elongated finishing roller and external thereto, said vibrating means being coupled to said at least one elongated finishing roller only at said second end thereof for vibrating said at least one elongated finishing roller, said vibrating means including first and second vibrator units, each vibrator unit including an eccentric mass adapted for rotation, said first and second vibrator units being synchronized in operation and having their respective eccentric masses rotating in opposite directions relative to one another, said suspension means including a secondary frame means extending transversely relative to the axis of said at least one finishing roller, said first and second vibrator units being carried by said secondary frame means and spaced apart laterally of one another; and said suspension means including isolating means interposed between said vibrating means and said carriage for preventing the transmission to said carriage of vibrational forces produced by said vibrating means.

2. The concrete finishing machine according to claim 1, wherein said secondary frame means includes a beam member supported above said finishing roller at said second end, and a frame member depending downwardly from said beam member, said suspension means including bearing means suspended by said frame member, said bearing means supporting said finishing cylinder at its second end, and said vibrating means being mounted on said beam member for vibrating said frame member and the bearing means supported thereby, whereby vibrational forces produced by said vibrating means are coupled to said finishing roller through said bearing means.

3. The concrete finishing machine according to claim 1, wherein said finishing roller means comprises first and second finishing rollers extending in parallel spaced side-by-side relation and each having first and second ends, said suspension means including a beam member located above said second ends of said first and second finishing rollers, and said first and second vibrator units being spaced apart laterally along said beam member with one of said vibrator units being located above said second end of said first finishing roller and the other vibrator unit being located above said second end of said second finishing roller, and said suspension means defining first and second finishing roller bearing means for individually supporting said second ends of said first and second finishing rollers.

4. The concrete finishing machine according to claim 3, wherein said isolating means comprises first and second isolating members each including a resilient body portion interposed between said beam member and said carriage, and at least third and fourth isolating members each including a resilient body portion interposed between said bearing means and said carriage.

5. The concrete finishing machine according to claim 3, wherein said first ends of said finishing rollers are located rearwardly of said carriage and said second ends of said finishing rollers are located forwardly of said carriage.

6. The concrete finishing machine according to claim 3, wherein said first ends of said finishing rollers are located forwardly of said carriage and said second ends of said finishing rollers are located rearwardly of said carriage.

7. In a concrete finishing machine including a main frame adapted for movement along a roadway or the like being surfaced, a finishing unit for finishing a concrete surface of the roadway, comprising:

a carriage supported by the main frame and adapted for movement back and forth along the main frame laterally of the roadway;

finishing roller means including first and second elongated finishing rollers extending in parallel spaced relation and each having first and second ends;

suspension means for rotatably mounting said finishing rollers to said carriage with said finishing rollers being located above the surface of the concrete being finished in engaging relationship therewith;

drive means supported on said carriage and coupled to said finishing rollers at said first ends thereof for rotating said finishing rollers as said carriage is moved along said main frame;

vibrating means supported by said suspension means near said second ends of said finishing rollers and external thereto, said vibrating means being coupled to said finishing rollers at said second ends thereof for vibrating said finishing rollers, said vibrating means including first and second vibrator units having respective first and second eccentric masses associated with said first and second finishing rollers, respectively, mounting means rotatably mounting said first and second eccentric masses for rotation in opposite directions relative to one another, said eccentric masses being coupled to the associated finishing roller near its second end, whereby vibrational forces reduced by said masses are coupled to said finishing rollers, said suspension means including first and second bearing means receiving the second ends of said first and second finishing rollers, respectively, and a common frame member supporting said first and second bearing means, mechanically interconnecting said first and second bearing means and said second ends of said finishing rollers supported therein, whereby horizontal components of the vibrational forces cancel one another and vertical components of the vibrational forces add to one another; and said suspension means including isolating means interposed between said vibrating means and said carriage for preventing the transmission to said carriage for preventing the transmission to said carriage of vibrational forces produced by said vibrating means.

8. The concrete finishing machine according to claim 7, wherein said mounting means comprises a first shaft extending through said first finishing roller and a second shaft extending through said second finishing roller, said first and second eccentric masses being carried on said first and second shafts, respectively, and being rotatable therewith independently of said finishing rollers.

9. The concrete finishing machine according to claim 8, wherein said mounting means comprises first and second bearing means secured to said first and second finishing rollers, respectively, and receiving said first and second shafts respectively.

10. The concrete finishing machine according to claim 7, wherein said first ends of said finishing rollers are located rearwardly of said carriage and said second ends of said finishing rollers are located forwardly of said carriage.

11. The concrete finishing machine according to claim 7, wherein said first ends of said finishing rollers are located forwardly of said carriage and said second ends of said finishing rollers are located rearwardly of said carriage.

12. In a concrete finishing machine including a main frame adapted for movement along a roadway or the like being surfaced, a finishing unit for finishing a concrete surface of the roadway, comprising:

a carriage supported by the main frame and adapted for movement back and forth along the main frame laterally of the roadway being surfaced, finishing roller means including first and second finishing rollers extending in parallel spaced side-by-side relation, each of said finishing rollers having fist and second ends, suspension means for rotatably mounting said finishing rollers to said carriage with said finishing rollers being located above the surface of the concrete being finished in engaging relationship therewith, said suspension means including a sub-frame having bearing means receiving said second ends of said first and second finishing rollers;

drive means coupled to said first ends thereof of said finishing rollers for rotating said finishing rollers as said carriage is driven relative to the main frame;

vibrating means supported by said sub-frame near said second ends of said finishing rollers and external thereto, said vibrating means being coupled to said finishing rollers near said second ends thereof, said vibrating means including first and second vibrator units having respective first and second eccentric masses associated with said first and second finishing rollers, respectively, mounting means rotatably mounting said first and second eccentric masses for rotation in opposite directions relative to one another, said eccentric masses being coupled to the associated finishing roller near its second end, whereby vibrational forces produced by said masses are coupled to said finishing rollers, said sub-frame mechanically interconnecting said bearing means and said second ends of said finishing rollers supported therein, whereby horizontal components of the vibrational forces cancel one another and vertical components of the vibrational forces add to one another; and said suspension means including isolating means interposed between said sub-frame and said carriage for preventing the transmission to said carriage of vibrational forces produced by said vibrating means.

13. The concrete finishing machine according to claim 12, wherein said sub-frame includes an elongated beam member supported above said finishing rollers at said second ends and first and second frame members depending downwardly from said beam member, said suspension means including first and second bearing means suspended by said first and second frame members, said first and second bearing means supporting said first and second finishing cylinders, respectively, at their second ends and said first and second vibrating units being mounted on said beam member for vibrating said frame members and said bearing means supported thereby, whereby vibrational forces produced by said vibrating means are coupled to said finishing rollers through said bearing means.

14. The concrete finishing machine according to claim 13, wherein said first and second vibrator units are spaced apart laterally along said beam member at opposite ends thereof with said first vibrator unit located above said second end of said first finishing roller and said second vibrator unit located above said second end of said second finishing roller.

15. The concrete finishing machine according to claim 14, wherein said isolating means comprises first and second isolating members each including a resilient body portion interposed between said beam member and said carriage, and at least third and fourth isolating members each including a resilient body portion interposed between said bearing means and said carriage.

16. The concrete finishing machine according to claim 12, wherein said mounting means comprises a first shaft extending through said first finishing roller and a second shaft extending through said second finishing roller, said first and second eccentric masses being carried on said first and second shafts, respectively, and being rotatable therewith independently of said finishing rollers.

17. The concrete finishing machine according to claim 16, wherein said mounting means comprises first and second bearing means secured to said first and second finishing rollers, respectively, and receiving said first and second shafts respectively.

18. In a concrete finishing machine including a main frame adapted for movement along a roadway or the like being surfaced, a finishing unit for finishing a concrete surface of the roadway, comprising:

a carriage supported by the main frame and adapted for movement back and forth along the main frame laterally of the roadway being surfaced, finishing roller means including first and second finishing rollers extending in parallel spaced side-by-side relation, each of said finishing rollers having first and second ends, suspension means for rotatably mounting said finishing rollers to said carriage with said finishing rollers being located above the surface of the concrete being finished in engaging relationship therewith; said suspension means including a sub-frame having first and second support means supporting, respectively, said second ends of said first and second finishing rollers;

drive means coupled to said first ends thereof of said finishing rollers for rotating said finishing rollers as said carriage is driven relative to the main frame;

vibrating means supported by said sub-frame near said second ends of said finishing rollers and external thereto, said vibrating means being coupled through said sub-frame to said first and second finishing rollers near said second ends thereof for producing vibrational forces which are applied through said sub-frame to said first and second finishing rollers; and said suspension means including isolating means interposed between said vibrating means and said carriage for preventing the transmission to said carriage of vibrational forces produced by said vibrating means.

19. The concrete finishing machine according to claim 18, wherein said sub-frame comprises a common frame member extending transverse to the axes of said finishing rollers adjacent to their second ends and mechanically interconnecting said first and second support means and said second ends of said finishing rollers supported therein.

20. In a concrete finishing machine including a main frame adapted for movement along a roadway or the like being surfaced, a finishing unit for finishing a concrete surface of the roadway, comprising:

a carriage supported by the main frame and adapted for movement back and forth along the main frame laterally of the roadway being surfaced;

finishing roller means including at least one finishing roller having a forward end and a rearward end, suspension means for rotatably mounting said at least one finishing roller to said carriage with said at least one finishing roller being located above the surface of the concrete being finished in engaging relationship therewith and having its forward end located forwardly of said carriage and its rearward end located rearwardly of said carriage, said suspension means including a sub-frame having means receiving said forward end of said at least one finishing roller;

drive means coupled to said rearward end of said at least one finishing roller for rotating said at least one finishing roller as said carriage is driven relative to the main frame;

vibrating means supported by said sub-frame near said forward end of said at least one finishing roller and external to said finishing roller, said vibrating means being coupled through said sub-frame to said at least one finishing roller only near said forward end thereof for producing vibrational forces which are applied through said sub-frame to said at least one finishing roller; and said suspension means including isolating means interposed between said vibrating means and said carriage for preventing the transmission to said carriage of vibrational forces produced by said vibrating means.

* * * * *

UNITED STATES PATENT AND TRADEMARK OFFICE

CERTIFICATE OF CORRECTION

PATENT NO. : 4,993,869

DATED : February 19, 1991

INVENTOR(S) : Ewarld R. Ulmer and Murray A. Rowe

It is certified that error appears in the above-identified patent and that said Letters Patent is hereby corrected as shown below:

Column 1, line 40 delete "id" and insert --is--;

Column 1, line 60 delete "sue" and insert --use--;

Column 2, line 52 delete "p";

Column 4, line 61 insert --(-- before "not";

Column 7, line 28 delete "isolates" and insert --isolators";

Column 7, line 42 delete "baring" and insert --bearing--;

Column 8, line 15 delete "94" and insert --194--;

Column 10, line 37 delete "riage for preventing the transmission to said car-";

Column 11, line 7 delete "fist" and insert --first--;

Signed and Sealed this

Fourteenth Day of July, 1992

*Attest:*

DOUGLAS B. COMER

*Attesting Officer*

*Acting Commissioner of Patents and Trademarks*